US007635250B2

(12) United States Patent
Montgomery et al.

(10) Patent No.: US 7,635,250 B2
(45) Date of Patent: Dec. 22, 2009

(54) APPARATUS AND METHOD FOR CONTROLLING LEAKAGE IN STEAM TURBINES

(75) Inventors: Michael Earl Montgomery, Niskayuna, NY (US); Robert Walter Hausler, Balston Spa, NY (US); Patrick Anthony Razzano, Jr., Latham, NY (US); James Michael Stagnitti, Schenectady, NY (US); Michael Thomas Hamlin, Burnt Hills, NY (US)

(73) Assignee: General Electric Company, Schenectady, NY (US)

( * ) Notice: Subject to any disclaimer, the term of this patent is extended or adjusted under 35 U.S.C. 154(b) by 525 days.

(21) Appl. No.: 11/386,303

(22) Filed: Mar. 22, 2006

(65) Prior Publication Data

US 2007/0220860 A1 Sep. 27, 2007

(51) Int. Cl.
*F01D 11/04* (2006.01)

(52) U.S. Cl. ..... 415/115; 415/144; 415/168.2

(58) Field of Classification Search ..... 415/111, 415/112, 115, 144, 168.1, 168.2
See application file for complete search history.

(56) References Cited

U.S. PATENT DOCUMENTS 3,291,447 A * 12/1966 Brandon ..... 415/111

* cited by examiner

*Primary Examiner*—Edward Look
*Assistant Examiner*—Aaron R Eastman
(74) *Attorney, Agent, or Firm*—Cantor Colburn LLP

(57) ABSTRACT

An apparatus for routing fluid in a steam turbine is provided. The steam turbine includes a stage comprising a plurality of buckets secured to a rotor. The rotor is configured to rotate in response to a first volume of fluid flowing from an inlet passageway past the plurality of buckets. The apparatus includes a member having a fluid passageway extending therethrough. The fluid passageway includes a first end in fluid communication with a discharge side of the stage of the steam turbine. A second volume of fluid comprising a portion of the first volume of fluid is received into the fluid passageway at the discharge side of the stage and is discharged out of an outlet of the fluid passageway. The outlet is in fluid communication with a region between an upstream side of the stage and a sealing member disposed against the rotor. The region receives a third volume of leakage fluid from the upstream side of the stage. The second volume of fluid discharged out of the outlet both reduces the third volume of leakage fluid entering the region and increases the first volume of fluid flowing past the plurality of buckets to increase an amount of torque of the rotor.

20 Claims, 8 Drawing Sheets

APPARATUS AND METHOD FOR CONTROLLING LEAKAGE IN STEAM TURBINES

BACKGROUND OF INVENTION

A steam turbine converts heat energy into mechanical energy for driving equipment such as generators, compressors, and pumps. The heat energy provided to the steam turbine is in the form of high temperature steam routed into the steam turbine. Steam turbines comprise a housing or shell, and at least one pressurized section, wherein each pressurized section comprises a plurality of stages having a plurality of rotating parts and a plurality of stationary parts.

Rotating components include a rotor and a plurality of buckets. The rotor extends through the pressurized section and is rotatably supported adjacent a shell member of the pressurized section. A portion of the rotor is operably couplable to a machine, to transfer energy thereto. The plurality of buckets is secured to the rotor and rotate with the rotor.

High temperature steam enters the pressurized section through at least one fluid inlet passageway. The steam is routed at a high velocity to a plurality of blades of a first stage. When the high velocity steam contacts the plurality of blades, the rotor begins to or continues to rotate. At each successive stage of the steam turbine, the same type of rotation is induced or continued. Steam having passed through the plurality of stages in the steam turbine exits the pressurized section and may be rerouted to another pressurized section of the steam turbine.

Although a majority of the steam performs work in the steam turbine by flowing through a plurality of stages as described above to rotate the rotor, there is a portion of the steam, leakage steam, that is lost to the work generation process. Leakage steam does not perform work in the steam turbine because the leakage steam does not rotate the rotor. Leakage steam that does not rotate the rotor in the steam turbine represents a loss of rotor torque.

Sealing members are used in the steam turbine to reduce the flow of leakage steam. Rotor torque of the steam turbine may be increased by reducing an amount of leakage steam. An example of a sealing member is an end packing head. One end packing head is generally positioned near end portions of a pressurized section of the steam turbine. For example, one end packing head is disposed over a portion of the rotor at an upstream side of a first stage plurality of buckets.

The end packing head is configured to reduce an amount of steam flowing between the end packing head and the rotor in a direction away from the first stage plurality of buckets. However, a measurable amount of leakage steam still undesirably passes between the rotor and the end packing head.

Accordingly, it is desirable to use steam that has previously performed work in the steam turbine to reduce an amount of steam that can flow between a sealing member and the rotor to make more steam available to rotate the rotor, thereby increasing rotor torque of the steam turbine.

BRIEF DESCRIPTION OF THE INVENTION

An apparatus for routing fluid in a steam turbine in accordance with an exemplary embodiment of the present invention is provided. The steam turbine includes a stage comprising a plurality of buckets secured to a rotor. The rotor is configured to rotate in response to a first volume of fluid flowing from an inlet passageway past the plurality of buckets. The apparatus includes a member having a fluid passageway extending therethrough. The fluid passageway includes a first end in fluid communication with a discharge side of the stage of the steam turbine. A second volume of fluid comprising a portion of the first volume of fluid is received into the fluid passageway at the discharge side of the stage and is discharged out of an outlet of the fluid passageway. The outlet is in fluid communication with a region between an upstream side of the stage and a sealing member disposed against the rotor. The region receives a third volume of leakage fluid from the upstream side of the stage. The second volume of fluid discharged out of the outlet both reduces the third volume of leakage fluid entering the region and increases the first volume of fluid flowing past the plurality of buckets to increase an amount of torque of the rotor.

An apparatus for routing fluid in a steam turbine in accordance with another exemplary embodiment of the present invention is provided. The steam turbine includes a stage comprising a plurality of buckets secured to a rotor. The rotor is configured to rotate in response to a first volume of fluid flowing from an inlet passageway past the plurality of buckets. The apparatus includes a first member and a second member. The first member includes a first fluid passageway extending therethrough. The first fluid passageway is in fluid communication with a discharge side of the stage of the steam turbine. A second volume of fluid comprising a portion of the first volume of fluid is received into the first fluid passageway from the discharge side of the stage. The second member includes a second fluid passageway extending therethrough that is in fluid communication with the first fluid passageway. The second volume of fluid is routed from the first fluid passageway into the second fluid passageway and is discharged out of an outlet of the second fluid passageway. The outlet is in fluid communication with a region between an upstream side of the stage and a sealing member disposed against the rotor. The region receives a third volume of leakage fluid from the upstream side of the stage. The second volume of fluid discharged out of the outlet both reduces the third volume of leakage fluid entering the region and increases the first volume of fluid flowing past the plurality of buckets to increase an amount of torque of the rotor.

A steam turbine in accordance with another exemplary embodiment of the present invention is provided. The steam turbine includes a rotor, a plurality of stages, a first member, and a second member. The rotor is rotatably received in the steam turbine. The plurality of stages is disposed in a facing spaced relationship with respect to each other. Each stage of the plurality of stages includes a plurality of buckets secured to the rotor. Each bucket of the plurality of buckets includes at least one blade secured thereto spaced apart from an adjacent blade. The rotor rotates when a first volume of fluid from an inlet passageway contacts the plurality of spaced blades and the first volume of fluid flows through a first stage plurality of buckets toward a second stage plurality of buckets by passing in a downstream direction between the plurality of spaced blades of the first stage plurality buckets to a discharge side of the first stage. The discharge side of the first stage defines an area between the first stage plurality of buckets and the second stage plurality of buckets. The first member includes a first fluid passageway extending therethrough. The first fluid passageway is in fluid communication with the discharge side of the first stage of the steam turbine. The second volume of fluid comprising a portion of the first volume of fluid is received into the first fluid passageway from the discharge side of the first stage. The second member is disposed about a portion of the rotor. The second member further includes a second fluid passageway extending therethough that is in fluid communication with the first fluid passageway. The second volume of fluid is routed from the first fluid passageway into the second fluid passageway and is discharged out of an outlet of the second fluid passageway. The outlet is in fluid communication with a region between an upstream side of the first stage and a sealing member disposed against the rotor. The region receives a third volume of leakage fluid from the upstream side of the first stage. The second volume of fluid discharged out of the outlet both reduces the third volume of leakage fluid entering the region and increases the first volume of fluid flowing past the first stage plurality of buckets to increase an amount of torque of the rotor.

DETAILED DESCRIPTION

Figure 1:
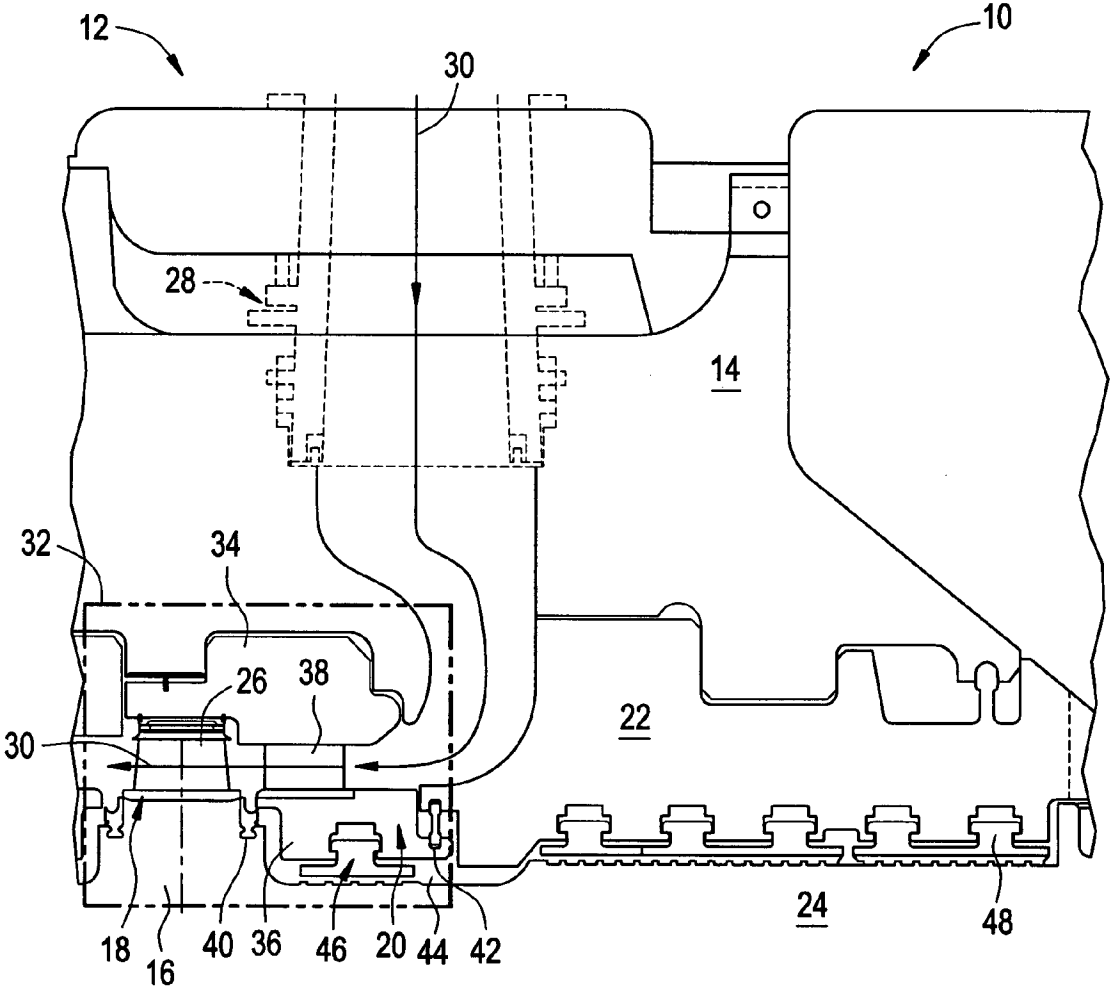
FIG. 1 is a sectional view of a portion of a pressurized section of a steam turbine.

This disclosure relates to routing a fluid through a portion of a steam turbine to increase a rotor torque of the steam turbine. More particularly, exemplary embodiments of the present invention are directed to routing a portion of steam that has performed work in the steam turbine so that leakage steam that has not performed work in the steam turbine is reduced so that more steam becomes available to perform work in the steam turbine, thereby increasing the rotor torque of the steam turbine.

In the exemplary embodiments discussed herein, a volume of steam is routed from a discharge side of a first stage of the steam turbine to a location upstream from the first stage. The volume of steam has performed work at the first stage before being routed. The volume of steam routed is discharged at the upstream location to reduce a volume of leakage steam proximate the upstream location, wherein the leakage steam has not performed work in the steam turbine. An advantage of the routing is that the volume of steam that has performed work in the steam turbine, thereby contributed to the rotor torque, is used to reduce a volume of leakage steam. The reduction of the volume of leakage steam results in an increase in a volume of steam that performs work in the steam turbine by rotating the rotor, thereby increasing the rotor torque of the steam turbine.

Steam turbines comprise a plurality of pressurized sections. In one configuration, for example, a steam turbine may comprise a high-pressure (HP) section, an intermediate (IP) or a reheat (RH) section, and a low-pressure (LP) section. In another configuration, a steam turbine may comprise an HP section, a RH section, and a LP section. Depending on the configuration of the steam turbine and the equipment the steam turbine supplies mechanical energy to, the steam turbine may comprise combinations of the pressurized sections.

Each pressurized section of the steam turbine includes a plurality of rotating components and a plurality of stationary components. Each pressurized section further includes a plurality of stages in a facing spaced relationship with respect to each other. For a steam turbine having an impulse configuration, the rotating components comprise a rotor, a plurality of wheel members, and a plurality of buckets. The rotor extends through the pressurized section and is rotatably supported adjacent to at least one stationary housing or shell member. Each of the plurality of stages of the pressurized section includes one wheel member secured to the rotor and a plurality of buckets secured to the wheel member. The wheel member and the plurality of buckets attached to the rotor generally have a substantially ring shaped configuration when disposed about a portion of the rotor. In a steam turbine having a reaction (drum-rotor) configuration, a plurality of buckets is secured to the rotor without being secured to a wheel member. The buckets and the rotor are configured to rotate within the shell member. The plurality of buckets at each stage include a plurality of spaced blades secured thereto.

In an exemplary embodiment, high-temperature steam or fluid from an inlet passageway is directed to contact the plurality of blades of a first stage plurality of buckets. As the fluid contacts the plurality of blades of the first stage plurality of buckets, the fluid rotates or continues to rotate the plurality of buckets, the wheel member, and the rotor. The fluid then passes through the first stage plurality of buckets in a downstream direction to a second stage. The fluid passes in the downstream direction through the successive plurality of stages in a substantially similar manner, thereby rotating the rotor an additional amount at each stage. An upstream direction is substantially opposite the downstream direction. A discharge area of the first stage is an area between the first and second stages where the fluid passes into after the fluid has rotated the rotor by contacting the plurality of blades of the first stage plurality of buckets. By rotating the rotor, the fluid performs work in the steam turbine.

Stationary components include at least one housing or shell member and a plurality of sealing members. The shell member is configured to enclose the rotor, wheel members, buckets, and sealing members therein. Shell members are also configured to route fluid at high pressures and temperatures therethrough. Shell members may be split into sections that are joined together to form a whole pressurized shell member. For example, a shell member may comprise an upper half that is secured to a lower half. The upper and lower shell halves are secured together to form a pressurized shell member within which other components are disposed therein. In an alternative configuration, a steam turbine may include an inner shell member disposed within an outer shell member. Only a portion of a shell member is shown in the Figures herein to illustrate the components inside the shell member.

The pressurized section may include a stationary guide member configured to direct the fluid to contact the plurality of blades of the plurality of buckets at a predetermined velocity and direction. In a steam turbine having an impulse configuration, the stationary guide member is a diaphragm member having a plurality of blade members (partitions) where the blade members are configured to direct the fluid to contact the plurality of blades. The diaphragm member is generally a substantially ring shaped member disposed over a portion of the rotor proximate the plurality of buckets on the upstream side of the plurality of buckets. In a steam turbine having a reaction (drum-rotor) configuration, the stationary guide member may be a blade ring having a plurality of blade members disposed in a blade carrier where the blade members are configured to direct the fluid to contact the plurality of blades.

A sealing member is generally a stationary member provided to substantially reduce fluid from flowing in a direction other than through the plurality of stages so the fluid performs work in the steam turbine. An end packing head is an example of a sealing member. The end packing head is disposed over a portion of the rotor at a position upstream from the first stage. The end packing head includes at least one sealing member configured to substantially reduce the flow of fluid between the sealing member and a periphery of the rotor. Fluid that does not perform work by flowing through the plurality of buckets and rotating the rotor is considered leakage fluid. Leakage fluid that does not perform work in the steam turbine is a loss of rotor torque. Therefore, it is desired to minimize the volume of leakage fluid, so more fluid performs work by rotating the rotor in the steam turbine.

Additionally, various sealing members are used at locations upstream from the first stage to reduce an amount of leakage fluid. In one configuration of a steam turbine, leakage fluid may flow through a root area. The root area is between a portion of the first stage plurality of buckets and a portion of the diaphragm member. Leakage fluid may flow through a bowl slot area that is between a portion of the diaphragm member and a portion of the end packing head. Leakage fluid may flow through an intermediate space along the rotor between the first stage and the end packing head. Sealing members may comprise one or more seal construction styles for reducing the flow of leakage fluid.

Accordingly, it is desired to route a volume of fluid that has performed work in the steam turbine, recycled fluid, from a discharge side of a stage to a location upstream from the stage, wherein the volume of recycled fluid reduces a flow of a volume of leakage fluid at the upstream location. The result of this arrangement is that more fluid becomes available to perform work by rotating the rotor in the steam turbine, thereby increasing the rotor torque of the steam turbine. Although the following exemplary embodiments of routing paths are applied at a first stage, it is intended that similar configurations of the routing paths may be applied at any stage of a steam turbine.

Referring now to FIG. 1, an example of a configuration of a portion of a pressurized section of a steam turbine is illustrated. Steam turbine 10 includes an outer shell member 12, an inner shell member 14, a wheel member 16, a first stage plurality of buckets 18, a diaphragm member 20 or guide member, an end packing head 22, and a rotor 24. The first stage plurality of buckets 18 includes a plurality of spaced blades 26 configured to direct the fluid through plurality of buckets 18 toward the second stage. FIG. 1 is a sectional view and therefore only shows a portion of one bucket and a blade secured to the bucket. Inner shell member 14 is disposed within outer shell member 12. Fluid enters outer shell member 12 through at least one fluid inlet passageway. Fluid then passes from outer shell member 12 into inner shell member 14 through a transition conduit 28 and flows along a flow path 30 toward the first stage plurality of buckets 18. Along flow path 30, the fluid is routed between a portion of inner shell member 14 and end packing head 22. A first stage area 32 extends from an area just before to just after the first stage plurality of buckets 18.

Diaphragm member 20 or guide member is a stationary member disposed on the upstream side of the first stage plurality of buckets 18. Diaphragm member 20 is configured to route fluid toward plurality of spaced blades 26 of the first stage plurality of buckets 18 along flow path 30. Diaphragm member 20 includes an outer ring 34, an inner ring web 36, and a plurality of spaced partitions 38 or blades disposed about a circumference of diaphragm member 20 between outer ring 34 and inner ring web 36. FIG. 1 is a sectional view and therefore only shows one partition of the plurality of partitions. Plurality of partitions 38 are configured to direct the fluid passing therethrough at a predetermined velocity and direction at plurality of blades 26 of the first stage plurality of buckets 18.

Figure 2:
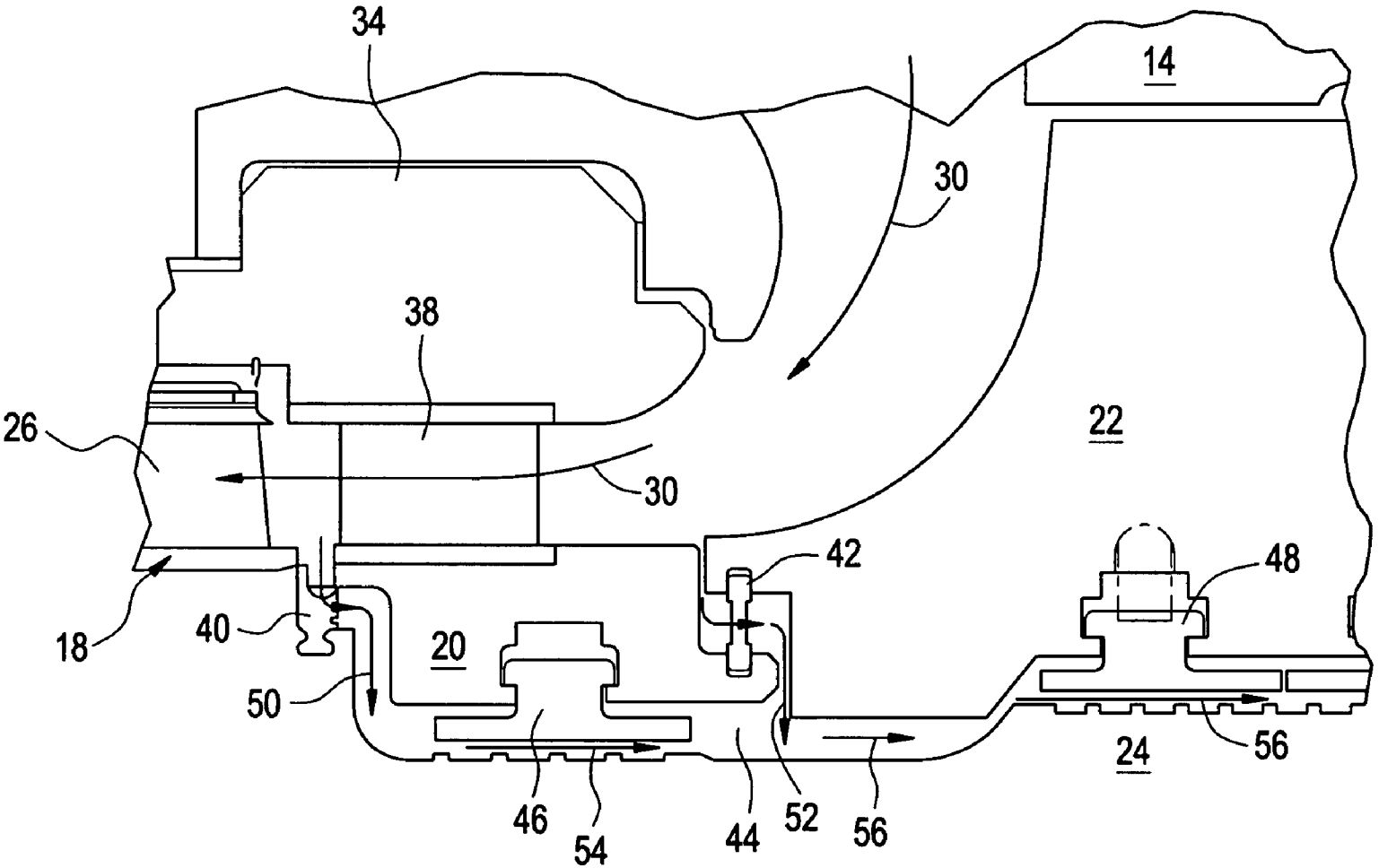
FIG. 2 is an enlarged sectional view of a portion of the pressurized section of FIG. 1 showing fluid flow paths within the pressurized section.

Referring now to FIG. 2, a portion of the fluid, leakage fluid, flows away from flow path 30 through a root seal 40 along a flow path 50 toward an intermediate space 44. Root seal 40 is disposed between a portion of the first stage plurality of buckets 18 and a portion of diaphragm member 20. Root seal 40 is configured to substantially reduce the flow of leakage fluid from flow path 30 into intermediate space 44. Another portion of leakage fluid from flow path 30 flows through a bowl slot seal 42 along a flow path 52. Bowl slot seal 42 is disposed between a portion of diaphragm member 20 and a portion of end packing head 22. Bowl slot seal 42 is configured to substantially reduce the flow of leakage fluid from flow path 30 into intermediate space 44. Additionally, to reduce fluid flowing through intermediate space 44 along a flow path 54, a sealing member 46 is disposed between diaphragm member 20 and a portion of rotor 24. End packing head 22 includes a plurality of sealing members 48 configured to substantially reduce fluid flow between end packing head 22 and rotor 24 along a flow path 56. Root seal 40, bowl slot seal 42, and sealing members 46 and 48 may comprise one or more seal construction styles for reducing the flow of leakage fluid therethrough. Leakage fluid is a portion of the fluid that flows through the above seal locations away from flow path 30 where the fluid has not performed work in the steam turbine.

Figure 3:
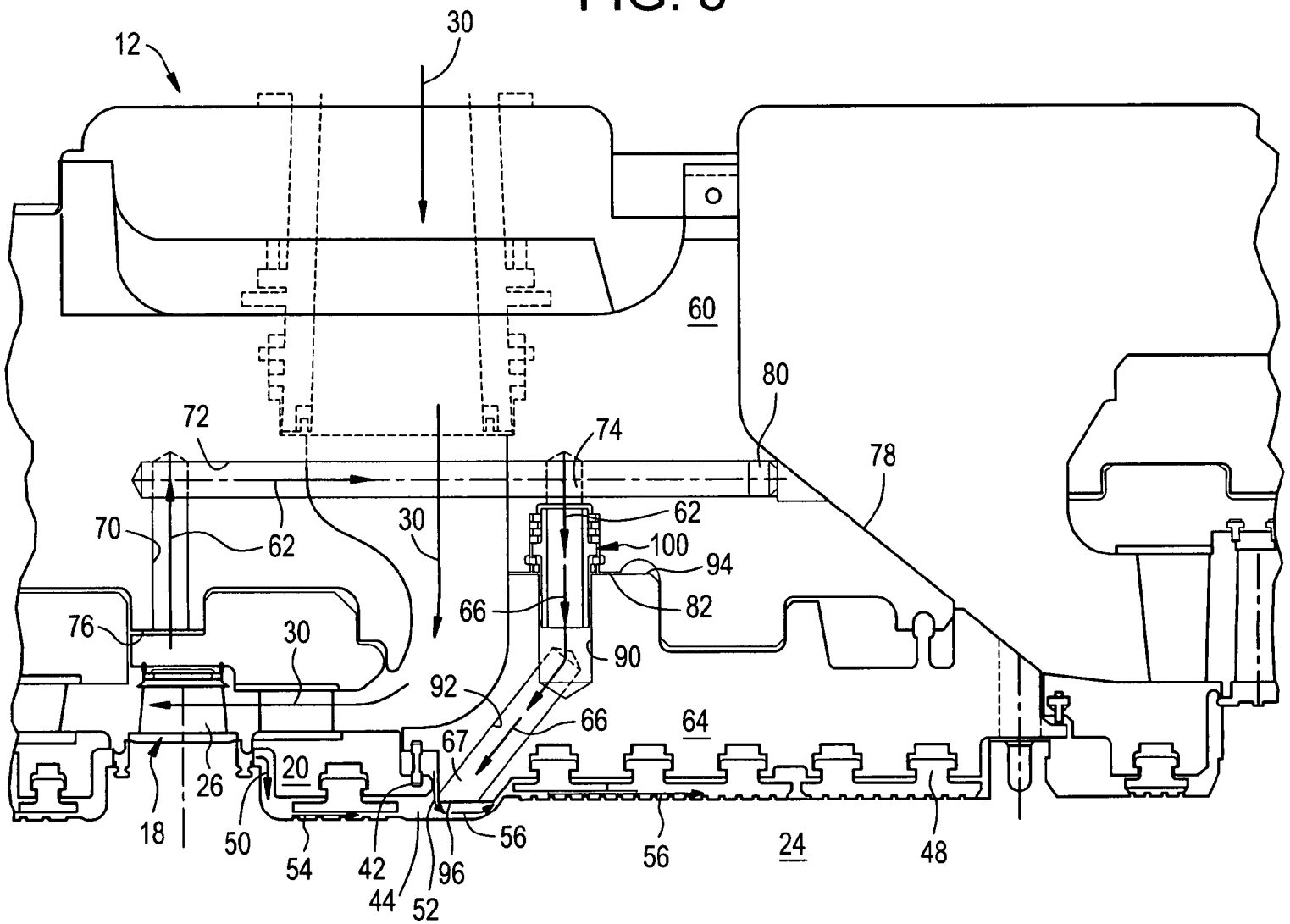
FIG. 3 is a sectional view illustrating a first fluid passageway and a second fluid passageway for routing a portion of a fluid in the pressurized section of FIG. 1 in accordance with an exemplary embodiment of the present invention.

Referring now to FIG. 3, an exemplary embodiment of directing a volume of recycled fluid from the discharge side of the first stage to a position upstream from the first stage by routing the recycled fluid through a member, here a shell member and an end packing head, is illustrated. The volume of recycled fluid from the discharge side of the first stage has performed work in the steam turbine because the recycled fluid has contacted blades 26 of the first stage plurality of buckets 18 and thereby rotated rotor 24. The routing is configured so the volume of recycled fluid discharged at the upstream location reduces a volume of leakage fluid along flow paths 50 and 52 from flowing between end packing head 64 and rotor 24 along flow path 56. In an exemplary embodiment, the routing is configured so the volume of recycled fluid is greater than the volume of leakage fluid at the upstream location, thereby decreasing the leakage rate through the end packing head. Consequently, when less fluid from flow path 30 flows along flow paths 50 and 52 more fluid exists in flow path 30 to perform work at the first and subsequent stages, thereby increasing the rotor torque of the steam turbine. The exemplary embodiments and principles for routing recycled fluid to reduce leakage fluid discussed herein may be applied to other configurations of steam turbines that have any number of leakage flow paths.

In an exemplary embodiment, an inner shell member 60 includes a first fluid passageway 62 and an end packing head 64 includes a second fluid passageway 66. Recycled fluid flows through inner shell member 60 by flowing through first fluid passageway 62. Recycled fluid flows through end packing head 64 by flowing through second fluid passageway 66. Fluid passageways 62 and 66 are configured so recycled fluid flows from the discharge side of the first stage through first fluid passageway 62 and into second fluid passageway 66. In an exemplary embodiment, second fluid passageway 66 includes a discharge outlet, wherein recycled fluid exits from the end packing head through the discharge outlet. The discharge outlet is disposed in a region between an upstream side of the first stage and a sealing member disposed against the rotor, wherein the region is not within the fluid inlet passageway. In a non-limiting embodiment, the discharge outlet is configured to discharge the recycled fluid from the end packing head in a manner directed along a periphery of rotor 24. In another alternative exemplary embodiment, the discharge outlet is configured to direct recycled fluid out of the end packing head in a direction that is not toward a periphery of rotor 24.

In an exemplary embodiment, first and second fluid passageways 62, 66 may be apertures through inner shell member 60 and end packing head 64, respectively. In an alternative exemplary embodiment, first fluid passageway 62 may comprise a conduit portion such as a pipe, sleeve, etc. disposed in inner shell member 60 for routing fluid therethrough. In another alternative exemplary embodiment, second fluid passageway 66 may comprise a conduit portion such as a pipe, sleeve, etc. disposed in end packing head 64 for routing recycled fluid therethrough. In another alternative exemplary embodiment, first and second fluid passageways 62, 66 may each comprise a portion of a transition conduit, for example, a pipe, sleeve, etc., for routing recycled fluid from first fluid passageway 62 into second fluid passageway 66. In other exemplary embodiments, combinations of apertures, conduit portions, and transition conduits may be used for routing recycled fluid from the discharge side of the first stage to a position upstream from the first stage via first and second fluid passageways 62, 66. In an alternative exemplary embodiment, a steam turbine pressurized section may include a single shell member and not an inner shell member, wherein the single shell member includes a first fluid passageway in fluid communication with a second fluid passageway.

In an exemplary embodiment, first fluid passageway 62 extends through inner shell member 60 and is defined by apertures 70, 72, and 74. Aperture 70 extends into inner shell member 60 from a surface 76 of inner shell member 60. Surface 76 is positioned so aperture 70 receives recycled fluid from the discharge side of the first stage. Aperture 72 extends into inner shell member 60 from a surface 78 disposed upstream from the first stage. A plug member 80 is disposed within aperture 72 proximate surface 78 to prevent recycled fluid from flowing out aperture 72 at surface 78. Aperture 74 extends into inner shell member 60 from a surface 82. Surface 82 is positioned so recycled fluid is discharged from first fluid passageway 62 at a position upstream from the first stage. Recycled fluid flows through apertures 70, 72, and 74 thereby routing the recycled fluid from the discharge side of the first stage to a position upstream from the first stage through inner shell member 60.

In an exemplary embodiment, second fluid passageway 66 extends through end packing head 64 and is defined by apertures 90 and 92. Aperture 90 extends into end packing head 64 from a surface 94. Aperture 92 extends into end packing head 64 from a surface 96. Surface 96 is positioned so that the recycled fluid discharges from second fluid passageway 66 on the upstream side of sealing members 48 of end packing head 64, relative to flow path 56. Recycled fluid flows from aperture 74 of inner shell member 60 into aperture 90 of end packing head 64. Recycled fluid exits end packing head 64 by flowing out of a discharge outlet 67 of second fluid passageway 66. First fluid passageway 62 and second fluid passageway 66 thus described are configured to route recycled fluid from the discharge side of the first stage to a position upstream from the first stage through inner shell member 60 and through end packing head 64. First and second fluid passageways 62, 66 are configured so the volume of recycled fluid discharged out of discharge outlet 67 reduces the flow of leakage fluid along flow paths 50 and 52 and increases the volume of fluid that rotates the rotor thereby increasing the rotor torque of the steam turbine.

Of course, alternative exemplary embodiments of first and second fluid passageways 62, 66 include other configurations for routing the volume of recycled fluid to the upstream position. For example, first and second fluid passageways 62, 66 may be formed with apertures orientated at angles different than apertures 70, 72, 74, 90 and 92 illustrated. In another alternative embodiment, first and second fluid passageways 62, 66 may comprise a different number of apertures for routing the volume of recycled fluid to the upstream position.

Figure 4:
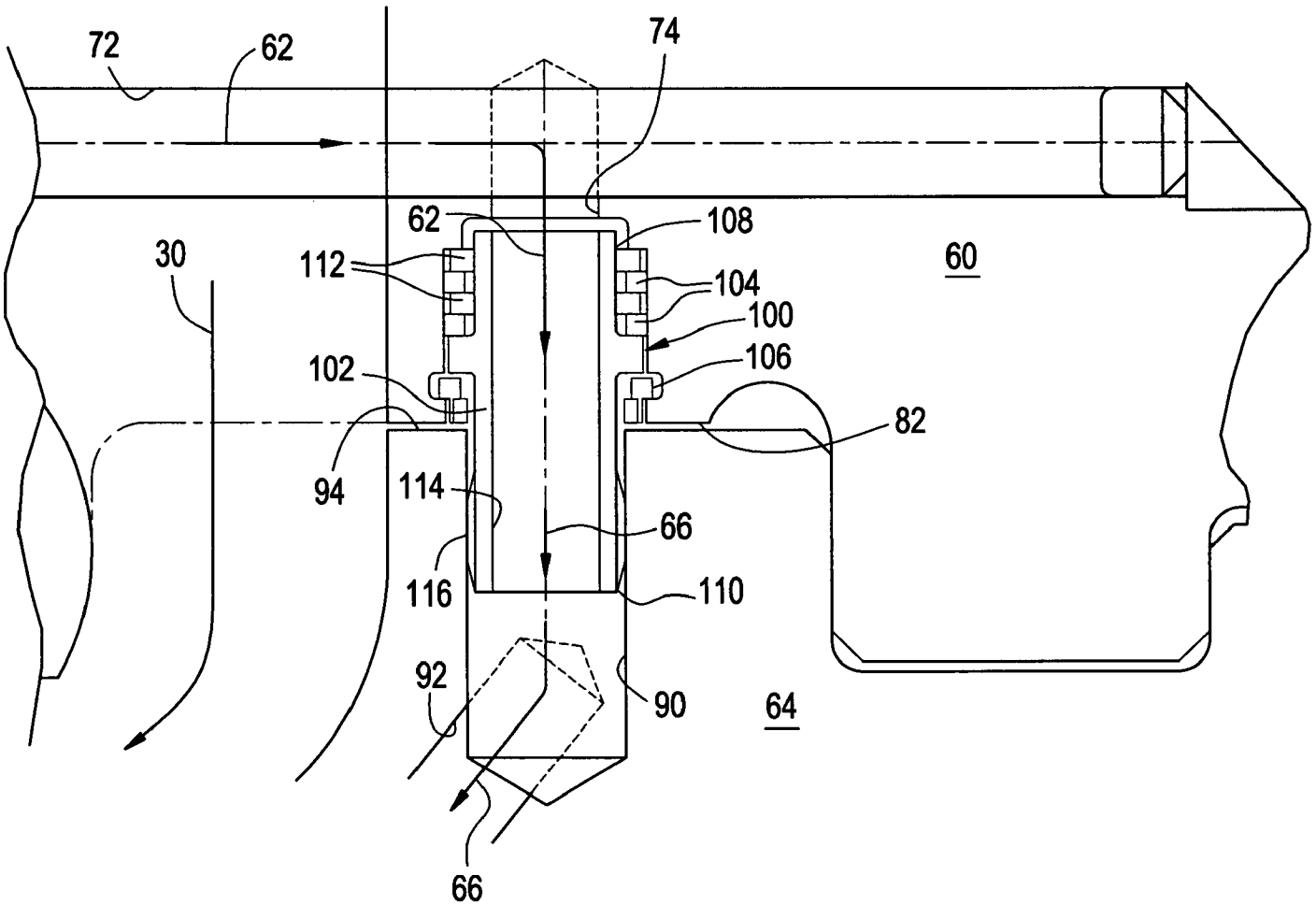
FIG. 4 is an enlarged view of a transition conduit utilized in the steam turbine of FIG. 3.

In an exemplary embodiment and referring now to FIGS. 3 and 4, a transition conduit 100 is disposed within a portion of first fluid passageway 62 and within a portion of second fluid passageway 66. Transition conduit 100 is provided to route recycled fluid from first fluid passageway 62 into second fluid passageway 66. Transition conduit 100 includes sealing portions configured to prevent fluid from flow path 30 from flowing into first and second fluid passageways 62, 66. For example, in an exemplary embodiment, at least one of the sealing portions is configured to have a zero clearance fit with mating surfaces of first or second fluid passageways 62, 66, during an operating condition of the steam turbine. In another exemplary embodiment, at least one of the sealing portions of transition conduit 100 includes a surface treatment configured so the transition conduit may be disposed into and removed from first and second fluid passageways 62, 66 with reduced galling of mating surfaces of transition conduit 100 and first or second fluid passageways 62, 66.

For example, in an exemplary embodiment, transition conduit 100 includes a connecting member 102, a plurality of sealing members 104, 112, and a retaining member 106. Connecting member 102 includes end portions 108 and 110, and an aperture 114 extending therethrough. End portion 108 is configured to be received within aperture 74 of inner shell member 60. End portion 110 is configured to be received within aperture 90 of end packing head 64. Recycled fluid flows from aperture 74 into aperture 90 by flowing through aperture 114 of connecting member 102. Plurality of sealing members 104, 112 are disposed proximate end portion 108 of connecting member 102. Sealing members 104, 112 are provided to prevent fluid from flow path 30 from flowing into first passageway 62. In an exemplary embodiment, an inner surface of each of sealing members 112 seals against an outer surface of connecting member 102 while an outer surface of each of sealing members 104 seals against an inner surface of aperture 74, and sealing members 104 and 112 seal against one another. Retaining ring 106 is configured to hold plurality of sealing members 104, 112 at a substantially fixed position within aperture 74. In an exemplary embodiment, sealing members 104, 112 are configured to have a zero clearance fit with a surface of aperture 74 and a surface of connecting member 102 during an operating condition of the steam turbine.

In an exemplary embodiment, end portion 110 includes a sealing portion 116 configured to be received within a portion of aperture 90 of end packing head 64. Sealing portion 116 is a curved surface of end portion 110 that has a zero clearance fit with an inner surface of aperture 90 during an operating condition of the steam turbine to prevent fluid from flow path 30 from flowing into second fluid passageway 66. In an exemplary embodiment, sealing portion 116 includes a surface treatment, for example, a stellite coating, to reduce galling of mating surfaces of connecting member 102 and an inner surface of aperture 90 when sealing portion 116 is disposed into and removed from second fluid passageway 66. Of course, in an alternative exemplary embodiment, end portion 108 could include a surface treatment while end portion 110 could include sealing members.

Figure 5:
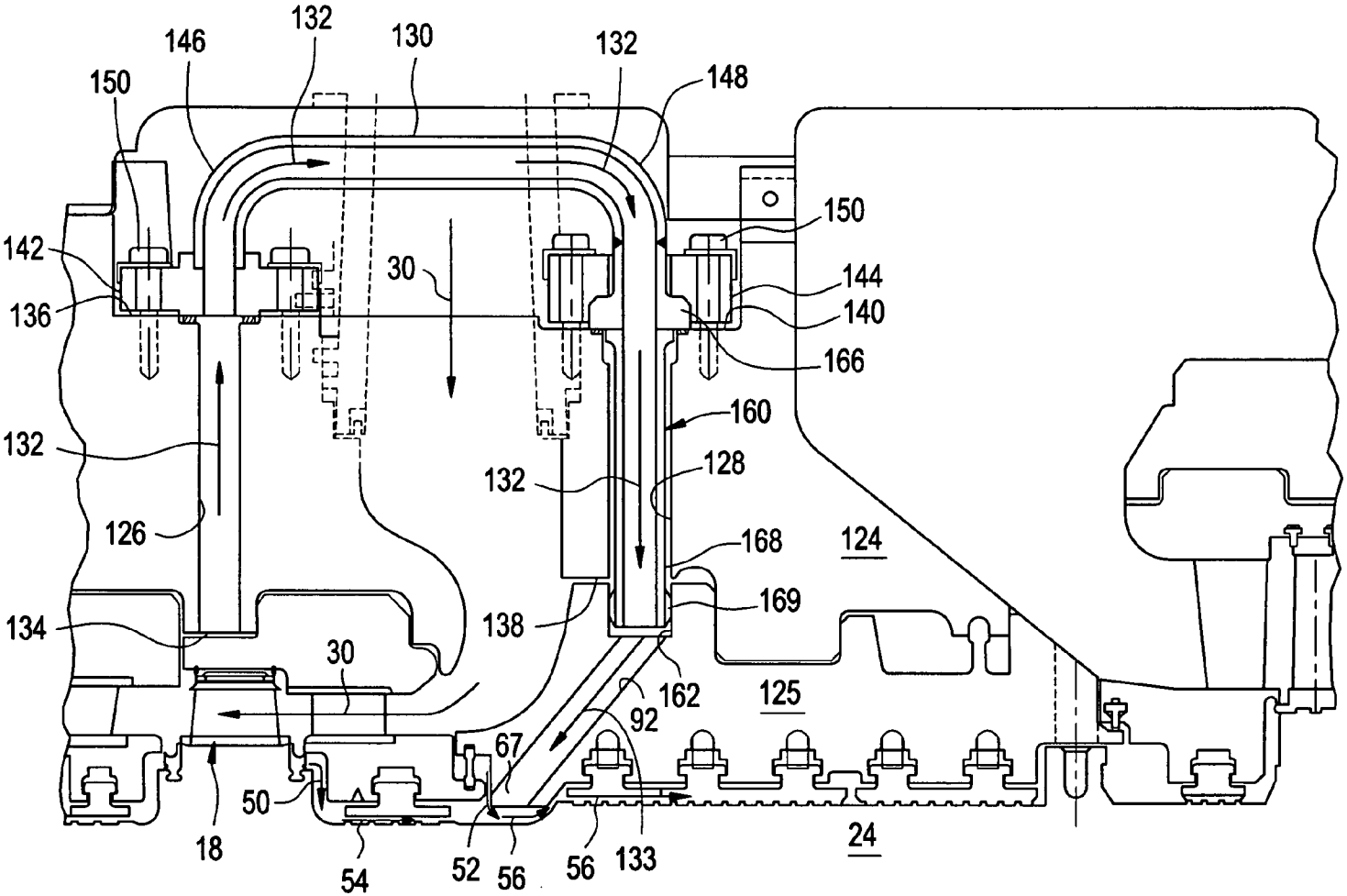
FIG. 5 is a sectional view illustrating a fluid passageway disposed at an exterior portion of a shell member for routing a portion of a fluid in the pressurized section of FIG. 1 in accordance with an alternative exemplary embodiment of the present invention.
Figure 6:
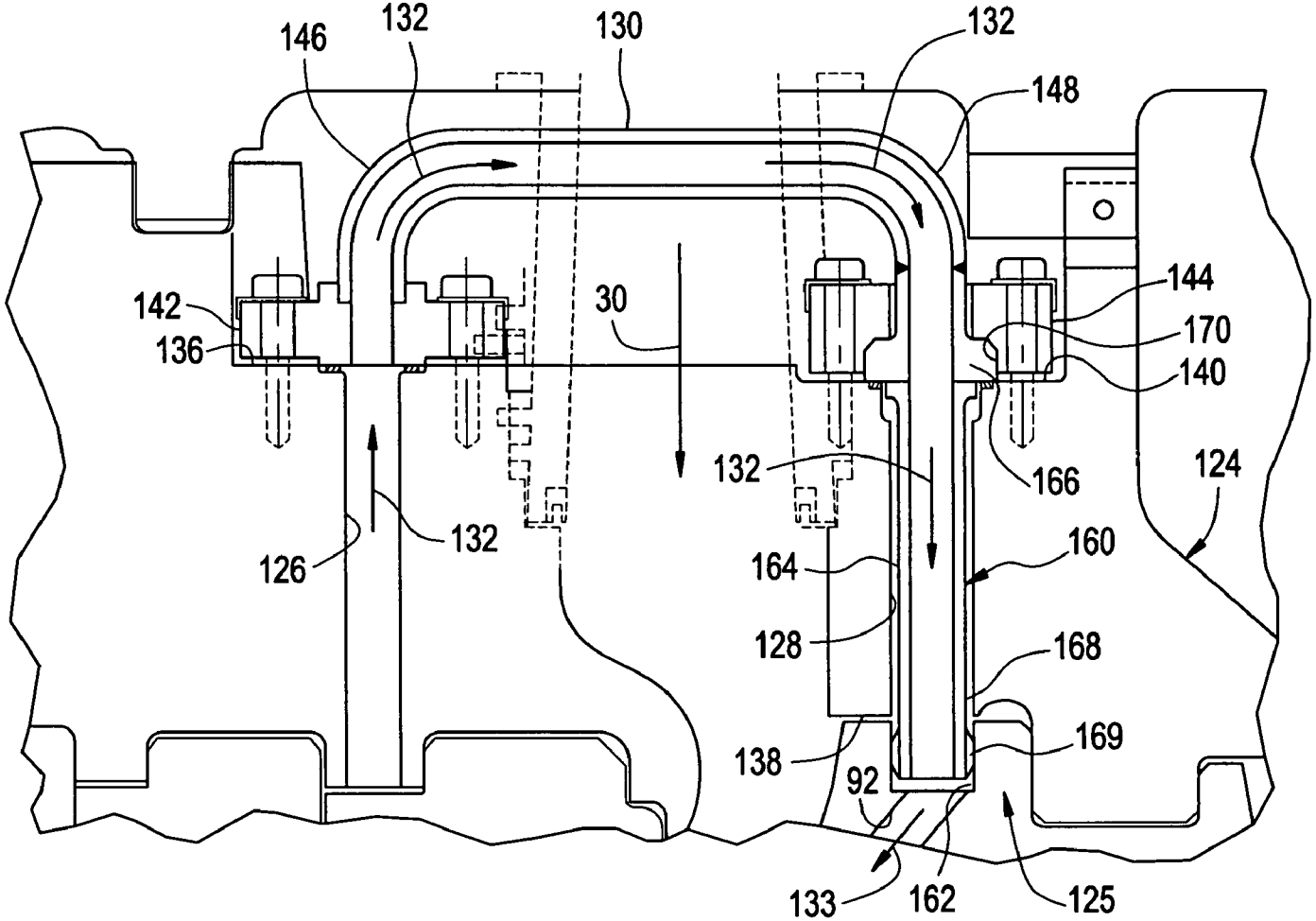
FIG. 6 is an enlarged view of a transition conduit utilized in the steam turbine of FIG. 5.

In an alternative exemplary embodiment as illustrated in FIGS. 5 and 6, a shell member includes an external conduit positioned at an exterior area of the shell member for routing recycled fluid from the discharge side of the first stage to a position upstream from the first stage. For example, in an exemplary embodiment, a first passageway of the shell member includes a first passageway portion, a second passageway portion, and a third passageway portion, wherein the second passageway portion is defined by the external conduit, such as a pipe, sleeve, etc., for routing recycled fluid from the first passageway portion into the third passageway portion. Of course, in alternative embodiments, any number of apertures may be disposed in a shell member in fluid communication with an external conduit disposed at an exterior area of the shell member.

For example, in an exemplary embodiment, an inner shell member 124 includes apertures 126 and 128, each extending through inner shell member 124. An external conduit 130 is disposed at an exterior area of inner shell member 124. Apertures 126, 128, and external conduit 130 define a first fluid passageway 132 through inner shell member 124. First fluid passageway 132 is configured to be in fluid communication with a second fluid passageway 133 disposed in an end packing head 125. External conduit 130 is configured to route recycled fluid from aperture 126 into aperture 128. For example, in an exemplary embodiment, external conduit 130 is a pipe secured to inner shell member 124 so recycled fluid flows from aperture 126 into aperture 128.

In an exemplary embodiment, aperture 126 extends through inner shell member 124 from an interior surface 134 to an exterior surface 136. Surface 134 is positioned so aperture 126 receives recycled fluid from the discharge side of the first stage. Aperture 128 extends through inner shell member 124 from an interior surface 138 to an exterior surface 140.

In an exemplary embodiment, external conduit 130 is secured to inner shell member 124 at surfaces 136, 140 so that recycled fluid does not escape from first passageway 132 or from aperture 128 to an exterior area of inner shell member 124. In one exemplary embodiment, flange members 142 and 144 are used to secure portions of external conduit 130 to inner shell member 124. In another exemplary embodiment, portions of external conduit 130 may be bolted or welded to inner shell member 124. In yet another exemplary embodiment, external conduit 130 may be secured to a transition conduit disposed in at least a portion of first or second fluid passageways 132, 133. In exemplary embodiments, external conduit 130 may be secured to inner shell member 124 in a manner that includes a sealing member such as a gasket or o-ring for preventing recycled fluid from escaping from first fluid passageway 132 to an exterior area of inner shell member 124.

In an exemplary embodiment and as illustrated in FIGS. 5 and 6, external conduit 130 includes end portions 146 and 148. End portion 146 of external conduit 130 is secured to flange member 142. End portion 148 of external conduit 130 is welded to a transition conduit 160. In an exemplary embodiment, flange members 142, 144 are secured to inner shell member 124 with bolts 150. In an alternative exemplary embodiment, flange members 142, 144 may be secured to inner shell member 124 or to external conduit 130 via threads. In another alternative exemplary embodiment, flange members 142, 144 may be welded to inner shell member 124 or to external conduit 130. First fluid passageway 132 and second fluid passageway 133 as described are configured to route recycled fluid from the discharge side of the first stage to a position upstream from the first stage through inner shell 124 and through end packing head 125. First and second fluid passageways 132, 133 are configured so the volume of recycled fluid discharged out of discharge outlet 67 reduces the flow of leakage fluid along flow paths 50 and 52 and increases the volume of fluid that rotates the rotor thereby increasing the rotor torque of the steam turbine.

In an alternative exemplary embodiment, first and second fluid passageways 132, 133 may include any number of apertures and conduit portions such as pipes, sleeves, etc. disposed in a portion of inner shell member 124 and or end packing head 125 for routing recycled fluid from the discharge side of the first stage to a position upstream from the first stage. Of course, in another exemplary embodiment, external conduit 130 may have a different configuration for routing recycled fluid from one portion of the inner shell member into another portion of the inner shell member.

In an exemplary embodiment, as illustrated in FIG. 6, transition conduit 160 is provided to route recycled fluid from external conduit 130 through aperture 128 of inner shell member 124 and into second fluid passageway 133 in end packing head 125. Transition conduit 160 includes a sealing portion configured to prevent recycled fluid from escaping from first fluid passageway 132 to an exterior area of inner shell member 124. Transition conduit 160 further includes a sealing portion configured to prevent fluid from flow path 30 from flowing into first or second fluid passageways 132, 133. For example, in an exemplary embodiment, a sealing portion of transition conduit 160 is configured to have a zero clearance fit with mating surfaces of first or second fluid passageways 132, 133, during an operating condition of the steam turbine. In another exemplary embodiment, a sealing portion of transition conduit 160 includes a surface treatment configured so the transition conduit may be disposed into and removed from first and second fluid passageways 132, 133 with reduced galling of mating surfaces of transition conduit 160 and first or second fluid passageways 132, 133.

For example, in an exemplary embodiment, transition conduit 160 includes a tubular portion 164 having end portions 166 and 168. Tubular portion 164 extends from end portion 148 of external conduit 130 through aperture 128 and into aperture 162 of second fluid passageway 133. Recycled fluid flows from external conduit 130 into aperture 162 by flowing through the bore of tubular portion 164. A portion of end portion 166 is secured between a recessed portion 170 of flange member 144 and surface 140 of inner shell member 124 and another portion of end portion 166 is welded to external conduit 130. In an alternative exemplary embodiment, a portion of transition conduit 160, such as end portion 166, may be welded or threaded to flange member 144. Additionally, sealing members such as a gasket or o-ring may be used between portions of external conduit 130, transition conduit 160, and inner shell member 124 to prevent recycled fluid from escaping from first fluid passageway 132 to an exterior area of inner shell member 124.

In an exemplary embodiment, end portion 168 includes a sealing portion 169 configured to be received within a portion of aperture 162 of end packing head 125. Sealing portion 169 is a curved surface that has a zero clearance fit with an inner surface of aperture 162 during an operating condition of the steam turbine. In another exemplary embodiment, sealing portion 169 includes a surface treatment, for example, a stellite coating, for reducing galling of mating surfaces of transition conduit 160 and an inner surface of aperture 162 when transition conduit 160 is disposed in or removed from second fluid passageway 133. Of course, in an alternative exemplary embodiment, transition conduit 160 may be configured so that end portion 168 includes a sealing member and end portion 166 includes a surface treatment. In another alternative exemplary embodiment, one transition conduit may extend from a portion of the external conduit into the third passageway portion of the first fluid passageway, while another transition conduit extends from the third passageway portion of the first fluid passageway into the second fluid passageway.

Figure 7:
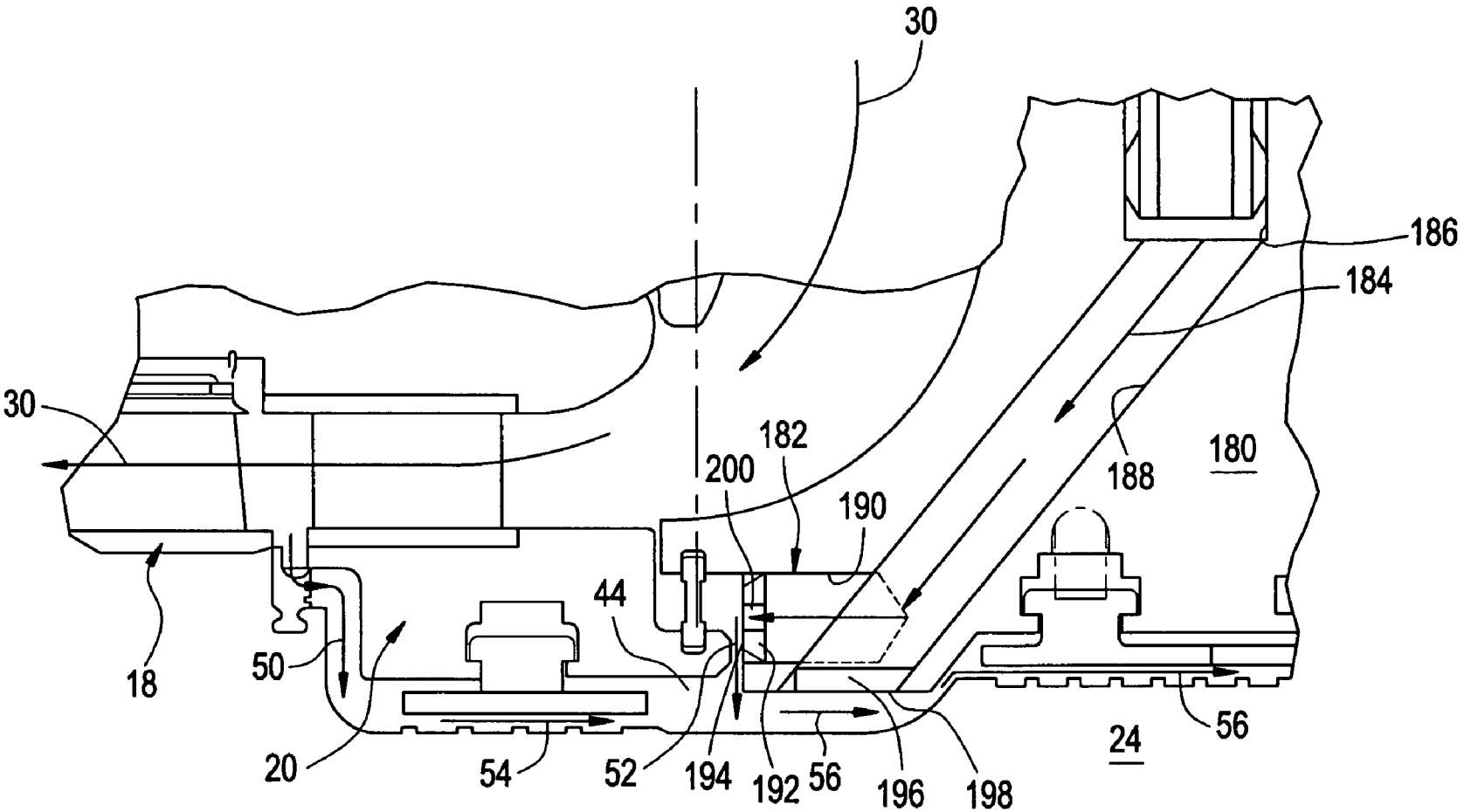
FIG. 7 is an enlarged view of an end packing head having a discharge outlet in accordance with an alternative exemplary embodiment of the present invention.

Referring now to FIG. 7, an exemplary embodiment of an end packing head 180 that includes a discharge outlet 182 is illustrated. Discharge outlet 182 is provided to route recycled fluid out of end packing head 180 in a direction that is not directly at a periphery of rotor 24. In an alternative exemplary embodiment, discharge outlet 182 is used in place of discharge outlet 67 illustrated in FIGS. 3 and 5. Routing recycled fluid out of the end packing head so the recycled fluid is not directed at the periphery of the rotor may be desired to minimize degradation of the rotor that may be caused by the recycled fluid. For example and in some conditions, recycled fluid directed at the rotor may cause asymmetrical heating or cooling, distortion, vibration, etc. of the rotor.

For example, in an exemplary embodiment, end packing head 180 includes a second fluid passageway 184 defined by apertures 186, 188, and 190. In this embodiment, apertures 186 and 188 may be positioned and configured substantially similar as apertures 162 and 92 of second fluid passageway 133 in FIG. 5. In an exemplary embodiment, discharge outlet 182 includes at least one aperture 190 and a plug member 192. Aperture 190 extends into end packing head 180 from a surface 194. Aperture 190 extends into end packing head 180 intersecting aperture 188 so recycled fluid flows through end packing head 180 by flowing through apertures 186, 188, and 190. In an alternative exemplary embodiment, aperture 190 is a circumferential groove extending into end packing head 180 from surface 194 when facing surface 194.

Plug member 196 is disposed within aperture 188 proximate a surface 198 of end packing head 180. Plug member 196 is configured to prevent the flow of recycled fluid out of end packing head 180 through aperture 188 at surface 198, so the fluid flows from aperture 188 into aperture 190. Plug member 192 is disposed within aperture 190 proximate surface 194. In an exemplary embodiment, plug member 192 includes at least one aperture 200 extending therethrough so recycled fluid is discharged from end packing head 180 by flowing from aperture 190 through aperture 200. Aperture 200 is positioned and configured so recycled fluid discharged from end packing head 180 through aperture 200 does not flow directly at the periphery of rotor 24.

In an alternative exemplary embodiment, a plurality of apertures 200 extending through a ring-shaped plug member 192 disposed within a circular groove shaped aperture 190 are spaced apart about a circumference of the ring-shaped plug member 192. A plurality of spaced apart apertures 200 may be desired to provide a more even distribution of recycled fluid about the periphery of rotor 24, and may be used, for example, when the recycled fluid may degrade rotor 24. In alternative exemplary embodiments, end packing head 64 of FIG. 3 and end packing head 125 of FIG. 5 may be modified to use a discharge outlet substantially similar to discharge outlet 182 of FIG. 7 instead of discharge outlet 67.

By employing the exemplary embodiments described above for routing a volume of recycled fluid from the discharge side of the first stage to a position upstream from the first stage reduces the volume of leakage fluid and makes more fluid available for rotating the rotor, thereby increasing the rotor torque of the steam turbine. Using recycled fluid is advantageous because the recycled fluid has already contributed to the output of the steam turbine by performing work in rotating the rotor.

The above exemplary embodiments described a shell member having one fluid passageway and an end packing head having one fluid passageway, for routing recycled fluid from the discharge side of the first stage to a position upstream from the first stage. It should be noted that alternative exemplary embodiments include configurations where a shell member and end packing head each have a plurality of circumferentially spaced apart fluid passageways for routing recycled fluid from the discharge side of the first stage to a position upstream from the first stage. A plurality of spaced apart fluid passageways in a shell member and in an end packing head may provide a greater volume of recycled fluid to the position upstream from the first stage. Additionally, a plurality of spaced apart fluid passageways in a shell member and in an end packing head may provide a more even distribution of recycled fluid through the shell member and the end packing head.

A plurality of spaced apart fluid passageways in a member may be desired to minimize degradation that the recycled fluid may impart to the member when routing the recycled fluid through the member via a single fluid passageway. For example, recycled fluid having a high temperature, pressure and or flow rate may have undesirable effects, such as asymmetrical heating or cooling, distortion, vibration, etc., on the member routing the recycled fluid therethrough. Thus, for example, in a non-limiting alternative embodiment, two sets of fluid passageways are circumferentially spaced 180° apart in each of a shell member and an end packing head. In another alternative embodiment, four sets of fluid passageways are circumferentially spaced 90° apart in each of a shell member and an end packing head.

Additionally, recycled fluid from a particular location in the steam turbine may be selected for routing based on a state of the recycled fluid corresponding to an amount of work the recycled fluid has performed in the steam turbine. For example, the amount of work the recycled fluid has performed may be determined from a state of the recycled fluid at a particular stage in the steam turbine. A state of the recycled fluid may be defined in terms of its energy level, enthalpy (BTU/lbm), temperature (F. °), and pressure (PSI). It is to be noted that fluid provided to the steam turbine just before the first stage in flow path 30 has a higher pressure and temperature than the recycled fluid and therefore the fluid in flow path 30 is at a higher energy level compared to the recycled fluid. Recycled fluid that has passed through the first stage and performed work has expanded to a lower pressure and temperature and therefore is at a lower energy level. Recycled fluid from the discharge side of any particular stage may be selected based on the state of the recycled fluid and routed to a position upstream from the stage for minimizing an amount of leakage fluid in the steam turbine and increasing the volume of fluid that performs work in the steam turbine, thereby increasing the rotor torque of the steam turbine.

Figure 8:
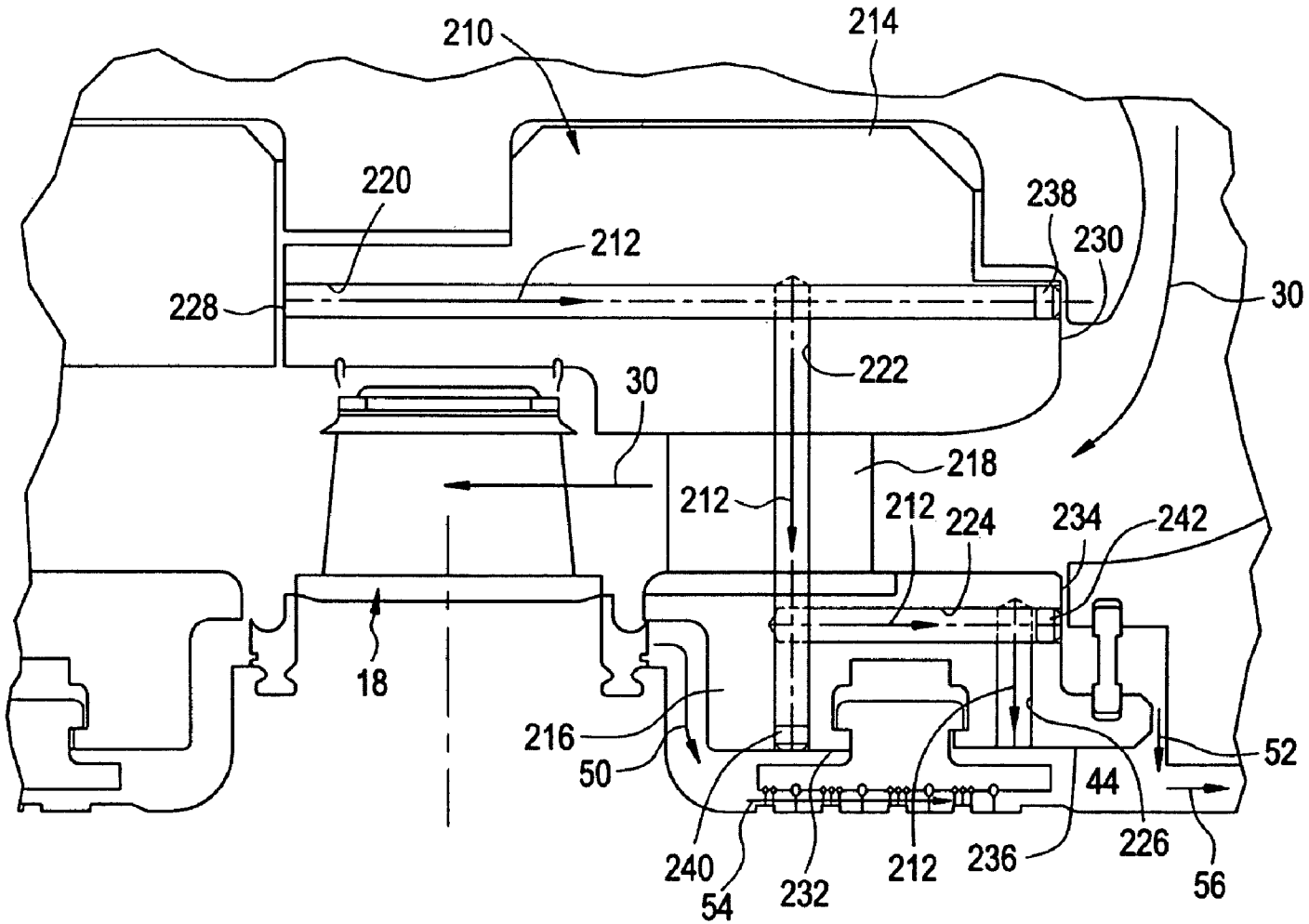
FIG. 8 is a sectional view illustrating a fluid passageway disposed in a stationary guide member for routing a portion of a fluid in the pressurized section of FIG. 1 in accordance with an alternative exemplary embodiment of the present invention.

Referring now to FIG. 8, in an alternative exemplary embodiment, a stationary guide member or member may be configured for routing recycled fluid from the discharge side of the first stage to a position upstream from the first stage. In an exemplary embodiment, the stationary member is a diaphragm member 210 that includes a fluid passageway 212 extending therethrough for routing recycled fluid from the discharge side of the first stage to a position upstream from the first stage. In an exemplary embodiment, diaphragm member 210 includes an outer ring 214, an inner ring web 216, and a plurality of partitions 218 or blade members. Only one partition is shown because FIG. 8 is a sectional view of diaphragm member 210.

In an exemplary embodiment, fluid passageway 212 is defined by apertures 220, 222, 224, and 226. Aperture 220 extends through outer ring 214 from a surface 228 to a surface 230. Surface 228 is positioned on a portion of outer ring 214 of diaphragm member 210 so aperture 220 may receive recycled fluid from the discharge side of the first stage. Aperture 222 extends into inner ring web 216 from a surface 232, extends through one of plurality of partitions 218, and then intersects aperture 220 in outer ring 214. In an alternative embodiment, fluid passageway 212 may extend through more than one of the plurality of partitions. Aperture 224 extends into inner ring web 216 from a surface 234 and intersects aperture 222. Aperture 226 extends into inner ring web 216 at a surface 236 and intersects aperture 224. Surface 236 is positioned so recycled fluid exits from diaphragm member 210 through a discharge outlet of aperture 226 at a position upstream from the first stage. Passageway 212 is configured so the volume of recycled fluid discharged out of the discharge outlet reduces the flow of leakage fluid along flow paths 50 and 52 and increases the volume of fluid that rotates the rotor thereby increasing the rotor torque of the steam turbine.

A plug member 238 is disposed within aperture 220 proximate surface 230 to prevent fluid from flow path 30 from flowing into aperture 220 at surface 230. A plug member 240 is disposed within aperture 222 proximate surface 232 to prevent from flow path 50 from flowing into aperture 222 at surface 232. A plug member 242 is disposed within aperture 224 proximate surface 234 to prevent from flow path 30 from flowing into aperture 224 at surface 234. Recycled fluid flows through diaphragm member 210 by flowing through apertures 220, 222, 224, and 226.

In an alternative exemplary embodiment, fluid passageway 212 may include a conduit portion, such as a pipe, for routing recycled fluid through diaphragm member 210. In another alternative embodiment, fluid passageway 212 may comprise apertures, pipes, sleeves or combinations thereof for routing recycled fluid from the discharge side of the first stage to a position upstream from the first stage. In another exemplary embodiment, the discharge outlet is configured so that recycled fluid is discharged out of the fluid passageway in a direction that is not directly at a periphery of the rotor, similar to discharge outlet 182 of end packing head 180 in FIG. 7. And in another alternative exemplary embodiment, the stationary guide member may include a first fluid passageway in fluid communication with a second fluid passageway disposed in another member for routing recycled fluid to an upstream position. Of course, in a steam turbine having a reaction (drum-rotor) configuration the stationary guide member may be a blade carrier having a plurality of blade members wherein the guide member includes a fluid passageway for routing recycled fluid from the discharge side of the first stage to a position upstream from the first stage.

In alternative exemplary embodiments, a plurality of spaced apart fluid passageways is disposed in the stationary guide member, e.g. diaphragm member, about the guide member's circumferential direction for routing recycled fluid from the discharge side of the first stage to a position upstream from the first stage. Having a plurality of spaced apart fluid passageways disposed in the guide member may be desired for a more even distribution of the recycled fluid flowing though the guide member. A plurality of spaced apart fluid passageways in the guide member may be desired to minimize undesirable effects the recycled fluid may have on the guide member when flowing through the guide member via a single passageway.

In another alternative exemplary embodiment, an end packing head or sealing member is integral with a stationary guide member, wherein the end packing head is disposed about a portion of the rotor. The guide member includes a fluid passageway for routing the recycled fluid therethrough from the discharge side of the first stage to a position upstream from the first stage. Recycled fluid exits from the guide member at the upstream position through a discharge outlet of the fluid passageway. In another exemplary embodiment, the discharge outlet is configured so that recycled fluid is discharged out of the fluid passageway in a direction that is not directly at a periphery of the rotor, similar to discharge outlet 182 of end packing head 180 in FIG. 7.

In another alternative exemplary embodiment, a shell member may be configured for routing recycled fluid from the discharge side of the first stage to a position upstream from the first stage, instead of routing the recycled fluid through a guide member. The shell member includes a fluid passageway for routing the recycled fluid therethrough from the discharge side of the first stage to a position upstream from the first stage. Recycled fluid exits from the shell member at the upstream position through a discharge outlet of the fluid passageway. In yet another alternative exemplary embodiment, the fluid passageway may include a passageway portion disposed at an exterior area of the shell member. In another exemplary embodiment, the discharge outlet is configured so that the recycled fluid is discharged out of the fluid passageway in a direction that is not directly at a periphery of the rotor, similar to discharge outlet 182 of end packing head 180 in FIG. 7.

In another alternative exemplary embodiment, an end packing head or sealing member is integral with a shell member, wherein the end packing head is disposed about a portion of the rotor. The shell member includes a fluid passageway for routing the recycled fluid therethrough from the discharge side of the first stage to a position upstream from the first stage. Recycled fluid exits from shell member at the upstream position through a discharge outlet of the fluid passageway. In another exemplary embodiment, the discharge outlet is configured so that recycled fluid is discharged out of the fluid passageway in a direction that is not directly at a periphery of the rotor, similar to discharge outlet 182 of end packing head 180 in FIG. 7.

The exemplary embodiments disclosed herein for routing a volume of recycled steam to both reduce a volume of leakage steam and increase the volume of steam available for rotating the rotor provide a substantial advantage over other methods for increasing the rotor torque of the steam turbine. Using a volume of recycled steam to increase rotor torque is advantageous because the recycled steam has previously performed work in the steam turbine by rotating the rotor, compared to steam, such as leakage steam, that has not performed work in the steam turbine.

While the invention is described with reference to an exemplary embodiment, it will be understood by those skilled in the art that various changes may be made an equivalence that may be substituted for elements thereof without departing from the scope of the invention. In addition, many modifications may be made to the teachings of the invention to adapt to a particular situation without departing from the scope thereof. Therefore, is intended that the invention not be limited the embodiment disclosed for carrying out this invention, but that the invention includes all embodiments falling with the scope of the intended claims. Moreover, the use of the term's first, second, etc. does not denote any order of importance, but rather the term's first, second, etc. are us are used to distinguish one element from another.

What is claimed is:

1. An apparatus for routing fluid in a steam turbine, the steam turbine having a first stage comprising a plurality of buckets secured to a rotor, the rotor being configured to rotate in response to a first volume of fluid flowing from an inlet passageway past the plurality of buckets, the apparatus comprising:

a member having a fluid passageway extending therethrough, a first end of the fluid passageway being in fluid communication with a discharge side of the first stage of the steam turbine, wherein a second volume of fluid comprising a portion of the first volume of fluid is received into the fluid passageway at the discharge side of the first stage and is discharged out of an outlet of the fluid passageway, the outlet being disposed in a region between an upstream side of the first stage and a sealing member disposed against the rotor, the region receiving a third volume of leakage fluid from the upstream side of the first stage, the third volume of leakage fluid flowing in a direction opposite to the first volume of fluid; and wherein the second volume of fluid discharged out of the outlet both reduces the third volume of leakage fluid entering the region and increases the first volume of fluid flowing past the plurality of buckets to increase an amount of torque of the rotor.

2. The apparatus as in claim 1, wherein the outlet is configured to direct the second volume of fluid in a direction that is not toward a periphery of the rotor and the second volume of fluid is steam.

3. The apparatus as in claim 1, wherein the sealing member is integral with the member.

4. An apparatus for routing fluid in a steam turbine, the steam turbine having a first stage comprising a plurality of buckets secured to a rotor, the rotor being configured to rotate in response to a first volume of fluid flowing from an inlet passageway past the plurality of buckets, the apparatus comprising:

a first member having a first fluid passageway extending therethrough, the first fluid passageway being in fluid communication with a discharge side of the first stage of the steam turbine, wherein a second volume of fluid comprising a portion of the first volume of fluid is received into the first fluid passageway from the discharge side of the first stage;

a second member having a second fluid passageway extending therethrough that is in fluid communication with the first fluid passageway, wherein the second volume of fluid is routed from the first fluid passageway into the second fluid passageway and is discharged out of an outlet of the second fluid passageway, the outlet being disposed in a region between an upstream side of the first stage and a sealing member disposed against the rotor, the region receiving a third volume of leakage fluid from the upstream side of the first stage, the third volume of leakage fluid flowing in a direction opposite to the first volume of fluid; and wherein the second volume of fluid discharged out of the outlet both reduces the third volume of leakage fluid entering the region and increases the first volume of fluid flowing past the plurality of buckets to increase an amount of torque of the rotor.

5. The apparatus as in claim 4, wherein the outlet is configured to direct the second volume of fluid in a direction that is not toward a periphery of the rotor and the second volume of fluid is steam.

6. The apparatus as in claim 4, further comprising a transition conduit, the transition conduit being configured to route the second volume of fluid from the first fluid passageway into the second fluid passageway, the transition conduit having first and second end portions, the first end portion being disposed in the first fluid passageway, the second end portion being disposed in the second fluid passageway, the first end portion having a sealing portion configured to prevent fluid flow between an outer surface of the first end portion and an inner surface of the first fluid passageway, the second end portion having a sealing portion configured to prevent fluid flow between an outer surface of the second end portion and an inner surface of the second fluid passageway.

7. The apparatus as in claim 6, wherein at least one of the sealing portions is further configured to provide a zero clearance fit between the outer surface of the first end portion and the inner surface of the first fluid passageway or between the outer surface of the second end portion and the inner surface of the second fluid passageway, during an operating condition of the steam turbine.

8. The apparatus as in claim 6, wherein at least one of the sealing portions further comprises a surface treatment configured so the transition conduit can be disposed into and removed from the first and second fluid passageways with reduced galling between the outer surface of the first end portion and the inner surface of the first fluid passageway or between the outer surface of the second end portion and the inner surface of the second fluid passageway.

9. The apparatus as in claim 4, wherein the first fluid passageway comprises a first passageway portion, a second passageway portion, and a third passageway portion, the first passageway portion extending through the first member, a first end of the first passageway portion being in fluid communication with the discharge side of the stage and a second end of the first passageway portion being disposed at an exterior surface of the first member, the second passageway portion being defined by an external conduit configured to provide fluid communication between the first passageway portion and the third passageway portion, the third passageway portion extending through the first member from the exterior surface and being in fluid communication with the second fluid passageway.

10. The apparatus as in claim 9, further comprising a transition conduit, the transition conduit being configured to route the second volume of fluid from the external conduit into the third passageway portion, the transition conduit having first and second end portions, the first end portion being disposed in the external conduit, the second end portion being disposed in the third passageway portion, the first end portion having a sealing portion configured to prevent fluid flow between an outer surface of the first end portion and an inner surface of the external conduit, the second end portion having a sealing portion configured to prevent fluid flow between an outer surface of the second end portion and an inner surface of the third passageway portion.

11. The apparatus as in claim 9, further comprising a transition conduit, the transition conduit being configured to route the second volume of fluid from the external conduit into the second fluid passageway, the transition conduit having first and second end portions, the first end portion being disposed in the external conduit, the second end portion being disposed in the second fluid passageway, the first end portion having a sealing portion configured to prevent fluid flow between an outer surface of the first end portion and an inner surface of the external conduit, the second end portion having a sealing portion configured to prevent fluid flow between an outer surface of the second end portion and an inner surface of the second fluid passageway.

12. The apparatus as in claim 11, wherein at least one of the sealing portions is further configured to provide a zero clearance fit between the outer surface of the first end portion and the inner surface of the external conduit or between the outer surface of the second end portion and the inner surface of the second fluid passageway, during an operating condition of the steam turbine.

13. The apparatus as in claim 11, wherein at least one of the sealing portions further comprises a surface treatment configured so the transition conduit can be disposed into and removed from the external conduit and the second fluid passageway with reduced galling between the outer surface of the first end portion and the inner surface of the external conduit or between the outer surface of the second end portion and the inner surface of the second fluid passageway.

14. A steam turbine, comprising:

a rotor rotatably received in the steam turbine;

a plurality of stages being disposed in a facing spaced relationship with respect to each other, each stage of the plurality of stages comprising a plurality of buckets secured to the rotor, wherein each bucket of the plurality of buckets having at least one blade secured thereto spaced apart from an adjacent blade, wherein the rotor rotates when a first volume of fluid from an inlet passageway contacts the plurality of spaced blades and the first volume of fluid flows through a first stage plurality of buckets toward a second stage plurality of buckets by passing in a downstream direction between the plurality of spaced blades of the first stage plurality buckets to a discharge side of the first stage, the discharge side of the first stage defining an area between the first stage plurality of buckets and the second stage plurality of buckets;

a first member having a first fluid passageway extending therethrough, the first fluid passageway being in fluid communication with the discharge side of the first stage of the steam turbine, wherein a second volume of fluid comprising a portion of the first volume of fluid is received into the first fluid passageway from the discharge side of the first stage;

a second member disposed about a portion of the rotor, the second member comprising a second fluid passageway extending therethrough that is in fluid communication with the first fluid passageway, wherein the second volume of fluid is routed from the first fluid passageway into the second fluid passageway and is discharged out of an outlet of the second fluid passageway, the outlet being disposed in a region between an upstream side of the first stage and a sealing member disposed against the rotor, the region receiving a third volume of leakage fluid from the upstream side of the first stage, the third volume of leakage fluid flowing in a direction opposite to the first volume of fluid; and wherein the second volume of fluid discharged out of the outlet both reduces the third volume of leakage fluid entering the region and increases the first volume of fluid flowing past the first stage plurality buckets to increase an amount of torque of the rotor.

15. The steam turbine as in claim 14, wherein the outlet is configured to direct the second volume of fluid in a direction that is not toward a periphery of the rotor and the second volume of fluid is steam.

16. The steam turbine as in claim 14, further comprising a transition conduit, the transition conduit being configured to route the second volume of fluid from the first fluid passageway into the second fluid passageway, the transition conduit having first and second end portions, the first end portion being disposed in the first fluid passageway, the second end portion being disposed in the second fluid passageway, the first end portion having a sealing portion configured to prevent fluid flow between an outer surface of the first end portion and an inner surface of the first fluid passageway, the second end portion having a sealing portion configured to prevent fluid flow between an outer surface of the second end portion and an inner surface of the second fluid passageway.

17. The steam turbine as in claim 14, wherein the first fluid passageway comprises a first passageway portion, a second passageway portion, and a third passageway portion, the first passageway portion extending through the first member, a first end of the first passageway portion being in fluid communication with the discharge side of the stage and a second end of the first passageway portion being disposed at an exterior surface of the first member, the second passageway portion being defined by an external conduit configured to provide fluid communication between the first passageway portion and the third passageway portion, the third passageway portion extending through the first member from the exterior surface and being in fluid communication with the second fluid passageway. ,

18. The steam turbine as in claim 17, further comprising a transition conduit, the transition conduit being configured to provide fluid communication between the external conduit and the second fluid passageway, the transition conduit having first and second end portions, the first end portion being disposed in the external conduit, the second end portion being disposed in the second fluid passageway, the first end portion having a sealing portion configured to prevent fluid flow between an outer surface of the first end portion and an inner surface of the external conduit, the second end portion having a sealing portion configured to prevent fluid flow between an outer surface of the second end portion and an inner surface of the second fluid passageway.

19. The steam turbine as in claim 18, wherein at least one of the sealing portions is further configured to provide a zero clearance fit between the outer surface of the first end portion and the inner surface of the external conduit or between the outer surface of the second end portion and the inner surface of the second fluid passageway, during an operating condition of the steam turbine.

20. The steam turbine as in claim 18, wherein at least one of the sealing portions further comprises a surface treatment configured so the transition conduit can be disposed into and removed from the external conduit and the second fluid passageway with reduced galling between the outer surface of the first end portion and the inner surface of the external conduit or between the outer surface of the second end portion and the inner surface of the second fluid passageway.

* * * * *